United States Patent [19]

Yealy

[11] 4,030,630

[45] June 21, 1977

[54] ALL PLASTIC RECLOSABLE CONTAINER CLOSURE

[75] Inventor: Carl F. Yealy, New Oxford, Pa.

[73] Assignee: Penland Container, Inc., Hanover, Pa.

[22] Filed: June 18, 1975

[21] Appl. No.: 588,097

[52] U.S. Cl. ..... 220/258; 220/270; 220/276; 215/256

[51] Int. Cl.² ..... B65D 51/22

[58] Field of Search ..... 220/266, 258, 257, 265, 220/269, 276; 215/254, 256

[56] References Cited

UNITED STATES PATENTS

| | | | |
|---|---|---|---|
| 2,383,274 | 8/1945 | Punte | 220/258 |
| 3,144,194 | 8/1964 | Cartwright | 220/266 X |
| 3,245,576 | 4/1966 | Griese, Jr. | 220/269 |
| 3,434,620 | 3/1969 | Laurizio | 220/258 |

FOREIGN PATENTS OR APPLICATIONS

| | | | |
|---|---|---|---|
| 443,349 | 2/1936 | United Kingdom | 220/258 |

*Primary Examiner*—William Price
*Assistant Examiner*—Joseph Man- Fu Moy
*Attorney, Agent, or Firm*—Seidel, Gonda & Goldhammer

[57] ABSTRACT

A first plastic closure member has a peripheral portion including a flange adapted to be secured to an opening in a container and a central frangible section integrally connected to the peripheral portion by a thin plastic portion which surrounds the central section. The central section is substantially flat and disc shaped and is devoid of any pull tab means extending upwardly therefrom. A tab element forms part of the central frangible section, lies in the same plane as the remaining parts of the central section and is integrally connected threto by a thin plastic portion which surrounds the element. A second plastic closure member is adapted to be releasably secured to the peripheral portion of the first closure member.

6 Claims, 5 Drawing Figures

FIG. 1
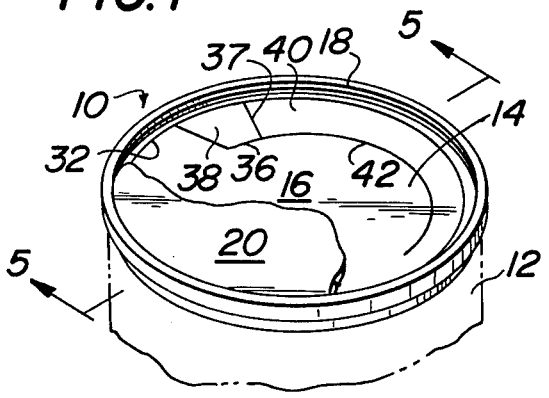
FIG. 2
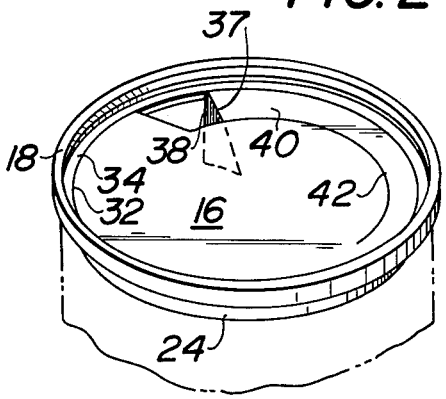
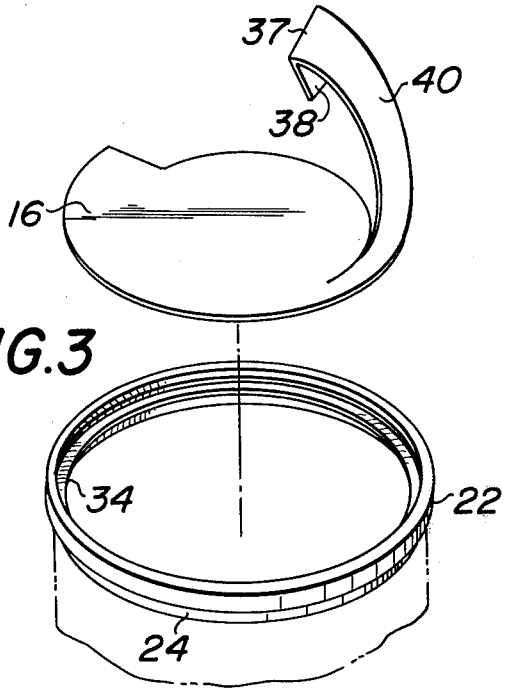
FIG. 3
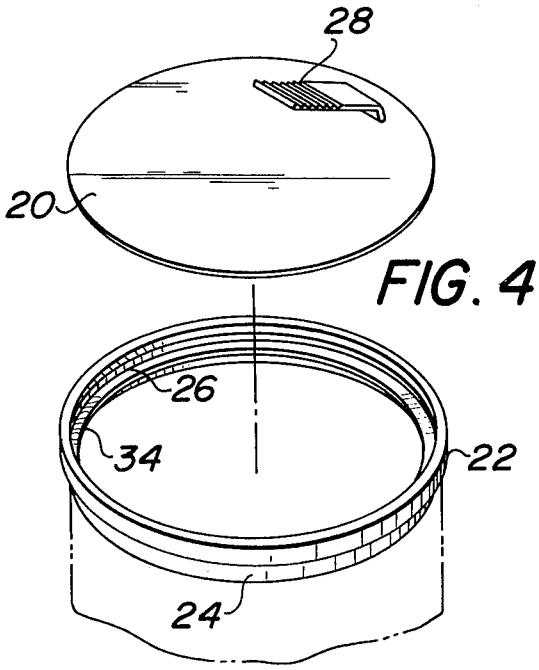
FIG. 4
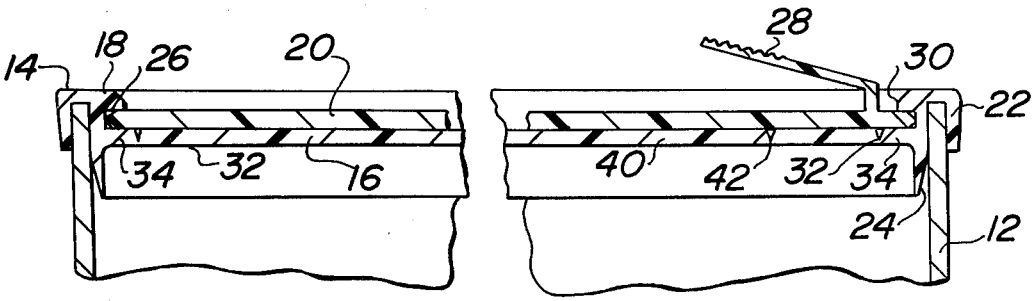
FIG. 5

ALL PLASTIC RECLOSABLE CONTAINER CLOSURE

This invention relates to an all plastic reclosable container closure and more particularly to a two-part plastic closure having a first member including a frangible section and a second member adapted to be releasably secured to a peripheral portion of the first member.

With the ever increasing popularity of convenience foods and other prepackaged products, there has been the need for a simple and convenient method of opening containers without the use of can openers or other similar utensils. To satisfy this need, several arrangements have been proposed in the past. The most widely adopted arrangement includes a score line around the edge of the top of a can and a pull tab fixedly secured to the can top. The top is removed by pulling the tab and tearing the top from the remaining part of the can along the score line. While this has proven to be an effective arrangement, it has many disadvantages. Firstly, it is relatively expensive to manufacture since the top and pull tab must be separately made and must then be joined together. Secondly, if the contents of the container are not totally used or comsumed, the remaining contents may spoil since there is no way of resealing the closure. Thirdly, and most importantly, the opened container is left with an extremely sharp metal edge around the periphery of the opening which can cause injury to the consumer.

To avoid some of these problems, it has been proposed to make such closure members from plastic. U.S. Pat. No. 3,499,572 is an example of one such proposal. This patent describes a closure member having a peripheral portion connected to a container and a central frangible portion connected to the peripheral portion by a thin plastic weld. The central portion also includes a tab member which is secured thereto and extends upwardly from the surface of the closure. The closure is opened by pulling the tab member thereby tearing the central portion from the peripheral portion. While this arrangement avoids injuries caused by the sharp metal edges of metal closures it is not totally satisfactory. The plastic closure member is difficult and therefore relatively expensive to manufacture because of the pull tab member extending upwardly from the surface of the closure. In addition, since the pull tab extends upwardly, it prevents the use of a second closure member over the first member for resealing the container after it has been opened.

The present invention overcomes all of the problems and disadvantages of the prior art and provides a closure member which is safe, and relatively inexpensive. More specifically, the novel container closure of the present invention includes a first plastic closure member having a peripheral portion including a flange which is adapted to be secured to an opening in a container. In addition, a central frangible section is integrally connected to the peripheral portion by a thin plastic portion which surrounds the entire central section. The central section is substantially flat and is devoid of any pull tab means extending therefrom. A tab element forms part of the central frangible section, lies in the same plane as the remaining parts of the central section and is integrally connected thereto by a thin plastic portion. A second plastic closure member is adapted to be releasably secured to the peripheral portion of the first closure member and can be used for reclosing the container once it has been opened.

It is, therefore, an object of the present invention to provide a container closure member which is safe and inexpensive.

It is another object of the present invention to provide a container closure member which includes a means for reclosing the container once it has been opened.

It is a further object of the present invention to provide a container closure member which is relatively simple to manufacture and use.

Further objects, advantages and details of the novel features of the present invention will become apparent from a consideration of the following description taken in conjunction with the accompanying drawing which illustrates a presently preferred form of the invention, it being understood, however, that this invention is not limited to the precise arrangements and instrumentalities shown.

FIG. 1 is a perspective view, partially broken away, of a reclosable container closure constructed in accordance with the principles of the present invention;

FIG. 2 is a perspective view, similar to FIG. 1, showing the manner in which the container closure member of the present invention is opened;

FIG. 3 is a perspective view showing the container closure after it has been opened;

FIG. 4 is a perspective view showing the manner in which the container closure of the present invention is reclosed, and FIG. 5 is a cross sectional view taken along the line 5—5 of FIG. 1.

Referring now to the drawing in detail wherein like numerals in each figure indicate like elements, there is shown in FIG. 1 an all plastic reclosable container closure constructed according to the principles of the present invention and generally indicated at 10. The closure 10, shown secured to and closing the open end of a tubular container 12, is comprised essentially of two parts: a first closure member 14 having a flat disc shaped central section 16 and a peripheral portion 18 and a second substantially disc shaped second closure member 20.

As best shown in FIG. 5, peripheral portion 18 of the first closure member 14 includes a flange 22 which is adapted to be secured, such as by gluing, to the wall of container 12. The lower inner section of flange portion 22 is tapered inwardly as shown at 24 in order to facilitate the alignment of the first closure member 14 with the container 12 during assembly.

Peripheral portion 18 of the first closure member 14 also includes an inwardly facing annular groove or recess 26. The peripheral edge of the second closure member 20 is adapted to be received in groove 26. As a result, the second closure member 20 can be temporarily but securely held in place over the opening at the top of container 12. A tab 28, integral with second closure member 20, is used to aid the removal of the second closure member 20 from the annular recess 26. In addition, as shown most clearly in FIG. 5 the upper inner edge of peripheral portion 18 of the first closure member 14 tapers downwardly as shown at 30. This taper 30 helps to guide the peripheral edge of the second member 20 into the groove 26 as it is forced downwardly into place.

Central section 16 of the first closure member 14 is provided with a plurality of reduced or thin plastic portions which aid in the removal of the central section 16 from the remaining parts of the first closure member 14 when it is desired to open the container 12. The first reduced or thin plastic portion 32 completely surrounds the central section 16 of the first closure member 14. Reduced portion 32, however, is located slightly radially inwardly from peripheral portion 18 thereby leaving a horizontally disposed annular ledge 34. This ledge 34 is adapted to engage and support the lower peripheral edge of the second closure member 20.

A second thin plastic portion 36, shown in FIG. 1, defines two inner sides of a tab element 38. Thin plastic portion 37 defines the third side and the fourth side of tab element 38 is defined by the thin plastic portion 32. Adjacent the tab 38 and secured thereto through thin plastic portion 37 is a partial spiral portion 40 which is defined on its outer edge by thin plastic portion 32 and on its inner edge by the reduced or thin plastic portion 42. It can be seen in FIGS. 1–3 that the partial spiral portion 40 extends approximately 180° about the central section 16 of the first closure member 14. In addition, the partial spiral portion 40 is tapered so that it is wider near its beginning than near its end.

The container closure of the present invention functions in the following manner. FIG. 1 shows a container 12 with the first and second closure member 14 and 20, respectively, in place and intact. For clarity, the second closure member 20 is shown partially broken away. When it is desired to open the container 12, the second closure member 20 is removed by pulling tab 28 upwardly. Thereafter, tab element 38 of the central section 16 is pushed downwardly into the container 12 as shown in FIG. 2. It can be seen that if downward pressure is put on tab element 38 adjacent the left-hand side, as view in FIG. 1, thin plastic portions 32 and 36 will break and the tab element 38 will remain hinged to partial spiral portion 40 by thin plastic portion 37. The partial spiral portion 40 is then grasped with one's fingers at the point where it adjoins tab element 38 which is forced under the partial spiral portion 40. Spiral portion 40 is thereafter pulled upwardly tearing thin plastic portions 42 and 32 thereby removing the entire central section 16 from the remaining parts of the first closure member 14 as shown in FIG. 3. When it is desired to reclose the container 12, the second closure member 20, as shown in FIG. 4, is forced into position with its peripheral edge in groove 26 and resting on ledge 34 of the first closure member 14.

The first and second closure members 14 and 20 may be composed of any suitable plastic material. It is preferred, however, to make the first closure member 14 from a low density polyethylene plastic. This will aid in tearing the central section 16 at the reduced plastic portions 32, 36 and 42. The second closure member 20 is preferably made from a high density polypropylene plastic which may be transparent or translucent so that the contents of the container can be seen through the second closure member 20. The reduced plastic portions 32, 36, 37 and 42 may be made by any conventional technique. For example, the first closure member 14 can be molded directly with the thin plastic portions therein or the upper and lower surfaces of the central portion 16 can be molded so as to be substantially flat and the reduced plastic portions can thereafter be formed by removing part of the thickness of the plastic at the proper areas such as by scoring.

The present invention may be embodied in other specific forms without departing from the spirit or essential attributes thereof and, accordingly, reference should be made to the appended claims, rather than to the foregoing specification as indicating the scope of the invention.

I claim:

1. An all plastic reclosable container closure comprising first and second plastic closure members, said first member being comprised of a thermoplastic material and having a flat substantially disc shaped central section and a peripheral portion integrally connected to and substantially surrounding said central section, part of said peripheral portion being adapted to be fixedly secured to a container to cover an opening in said container, said central section being connected to said peripheral portion by a first thin plastic portion which completely surrounds said central section, the thickness of said thin plastic portion being substantially less than the thickness of either said central section or said peripheral portion whereby said central section can be torn from said peripheral portion, part of said central section being composed of a tab element connected to the remaining part of said central section by a second thin plastic portion which completely surrounds said tab element, the thickness of said second thin plastic portion being substantially less than the thickness of said central section, said central section being further composed of a partial spiral portion one end of which is located adjacent said tab element whereby said central section can be torn from said peripheral portion by pushing said tab element inwardly and lifting the said one end of said partial spiral section, said entire central section including said tab element lying substantially in a single plane, said second closure member being adapted to cover said central section and being adapted to be releasably connected to the peripheral portion of said first closure member whereby said container closure is opened by removing said second closure member, pushing said tab portion inwardly and tearing said central section from said peripheral portion.

2. An all plastic reclosable container closure as claimed in claim 1 wherein said peripheral portion includes an annular recess and wherein part of said second closure member is adapted to be received in said annular recess.

3. An all plastic reclosable container closure as claimed in claim 2 wherein said annular recess faces inwardly, said second closure member being substantially disc shaped and having a peripheral edge adapted to be received in said annular recess.

4. An all plastic reclosable container closure as claimed in claim 3 wherein said second closure member includes an upwardly extending tab means.

5. An all plastic flangible container closure comprising a flat substantially disc shaped central section and a peripheral portion integrally connected to and substantially surrounding said central section, said central section and said peripheral portion being comprised of a thermoplastic material, part of said peripheral portion being adapted to be fixedly secured to a container to cover an opening in said container, said central section being connected to said peripheral portion by a first thin plastic portion which completely surrounds said central section, the thickness of said thin plastic portion being substantially less than the thickness of either said central section or said peripheral portion whereby said central section can be torn from said pheripheral portion, part of said central section being composed of a tab element connected to the remaining part of said central section by a second thin plastic portion which completely surrounds said tab element, the thickness of said second thin plastic portion being substantially less than the thickness of said central section, said central section being further composed of a partial spiral portion one end of which is located adjacent said tab element whereby said central section can be torn from said peripheral portion by pushing said tab element inwardly and lifting the said one end of said partial spiral portion, said entire central section including said tab element lying substantially in a single plane, whereby said container closure is opened by pushing said tab portion inwardly and tearing, said central section from said peripheral portion.

6. An all plastic frangible container closure as claimed in claim 5 wherein said central section is further composed of a partial spiral portion one end of which is located adjacent said tab element whereby said central section can be torn from said peripheral portion by pushing said tab element inwardly and lifting the said one end of said partial spiral portion.

* * * * *